United States Patent [19]

Mountford

[11] Patent Number: 4,805,701

[45] Date of Patent: Feb. 21, 1989

[54] FIRE EXTINGUISHER AND ALARM APPARATUS

[76] Inventor: George S. Mountford, 434 Lake View Ct., Lowell, Ind. 46356

[21] Appl. No.: 35,175

[22] Filed: Apr. 7, 1987

[51] Int. Cl.[4] ..... A62C 37/12

[52] U.S. Cl. ..... 169/57; 169/26; 169/23; 116/112

[58] Field of Search ..... 169/57, 26, 23, 19, 169/20, 56, 59, 54, 42, DIG. 3, 58, 37, 38, 41, 28–30, 74; 116/4, 70, 106, 101, 112; 222/54; 239/72, 75

[56] References Cited

U.S. PATENT DOCUMENTS

| | | | |
|---|---|---|---|
| 243,847 | 7/1881 | Burritt | 164/42 X |
| 458,171 | 8/1891 | Johnson | 169/26 |
| 869,415 | 10/1907 | Buell | 169/20 |
| 1,491,301 | 4/1924 | Grafflin | 169/20 |
| 1,966,661 | 7/1934 | Doughty | 169/26 |
| 2,777,416 | 1/1957 | Messick | 116/112 X |
| 3,536,139 | 10/1970 | Berti | 169/29 |
| 3,664,430 | 5/1972 | Sitabkhan | 169/42 X |
| 3,670,690 | 6/1972 | Swanson | 239/579 X |
| 3,800,878 | 4/1974 | Poitras | 169/57 X |
| 3,907,037 | 9/1975 | Linsalato et al. | 169/57 |
| 4,013,127 | 3/1977 | Tenney et al. | 169/57 |
| 4,034,813 | 7/1977 | Le Day | 169/26 |
| 4,098,220 | 7/1978 | Yuhas | 116/106 |
| 4,253,527 | 3/1981 | Wilhoit | 169/57 |
| 4,506,737 | 3/1985 | Pare | 169/19 |
| 4,532,996 | 8/1985 | Wilson et al. | 169/23 |

*Primary Examiner*—Sherman D. Basinger
*Assistant Examiner*—Paul E. Salmon
*Attorney, Agent, or Firm*—Richard G. Kinney

[57] ABSTRACT

A fire extinguisher and alarm apparatus for a container having a rim and a cavity to retain combustible materials comprising a reservoir having a chamber for retaining a fire extinguishing fluid under gas pressure, a hollow nozzle for ejecting the fire extinguishing fluid, a temperature sensitive device which softens in the presence of heat, a device for mounting the reservoir on the container rim with the nozzle and temperature sensitive device located ajacent the container cavity, an alarm which issues an audible signal responsive to gas under pressure, and a valve responsive to softening of the temperature sensitive device for simultaneously connecting the fire extinguishing fluid in the reservoir to the nozzle for ejection therethrough into the container cavity and connecting the gas under pressure in the reservoir to the alarm to issue the audible signal.

17 Claims, 4 Drawing Sheets

FIRE EXTINGUISHER AND ALARM APPARATUS

BACKGROUND OF THE INVENTION

The present invention relates to fire extinguisher and alarm apparatuses.

Frequently, highly combustible materials are temporarily stored in wastebaskets or other suitable containers until permanent disposition may be made of the materials. Such containers are a possible source of fire which may arise from spontaneous combustion of the stored flammable materials or carelessness of an employee in discarding a lighted cigarette or match into the container.

Several fire extinguishers have been proposed to extinguish fires in such containers. The U.S. patent Le Day, U.S. Pat. No. 4,034,813, proposes a fire extinguisher and alarm, but the device is mounted on the wall, and the extinguisher may miss the container if the container is misaligned with the extinguisher. Also, the extinguisher of that patent is located too high relative to the container, and it may be actuated too late to extinguish the fire. Also, the device of that patent requires a relatively high velocity of fluid to actuate the alarm which is directed at the contents of the container, and this high-velocity fluid may spread burning paper or other materials to locations outside the container in the room, which might start other fires.

The U.S. patent Wilson, et al, U.S. Pat. No. 4,532,996, also proposes a fire extinguisher for containers. However, the device of this patent requires separate reservoirs for a fire extinguishing fluid and an alarm fluid and is unduly complex in construction. Also, this unit sounds its alarm only after discharging the fire extinguishing fluid—a delay which could prove most harmful in an emergency situation.

SUMMARY OF THE INVENTION

A principal feature of the present invention is the provision of an improved fire extinguisher and alarm apparatus for a container having a rim and a cavity to retain combustible materials.

The fire extinguisher and alarm apparatus of the present invention comprises a reservoir having a chamber for retaining a fire extinguishing fluid under gas pressure, a hollow nozzle for ejecting the fire extinguishing fluid, temperature sensitive means which softens in the presence of heat, means for mounting the reservoir on the container rim with the nozzle and temperature sensitive means located adjacent the container cavity, and an alarm which issues an audible signal responsive to gas under pressure.

A feature of the present invention is the provision of valve means responsive to softening of the temperature sensing means for simultaneously connecting the fire extinguishing fluid in the reservoir to the nozzle for ejection therethrough into the container cavity and connecting the gas under pressure in the reservoir to the alarm to issue the audible signal.

Another feature of the invention is that the fire extinguishing fluid for extinguishing the fire and the gas for actuating the alarm are retained in a single reservoir.

Yet another feature of the invention is that the apparatus is mounted on the container rim in a position to sense and extinguish the fire.

A further feature of the invention is that the fire extinguishing fluid may be ejected at a velocity sufficiently low so as to not disturb and blow burning materials out of the container.

A feature of the present invention is that the apparatus is of simplified construction and may be manufactured at a reduced cost.

Further features will become more fully apparent in the following description of the embodiments of this invention and from the appended claims.

DESCRIPTION OF THE PREFERRED EMBODIMENTS

Figure 1:
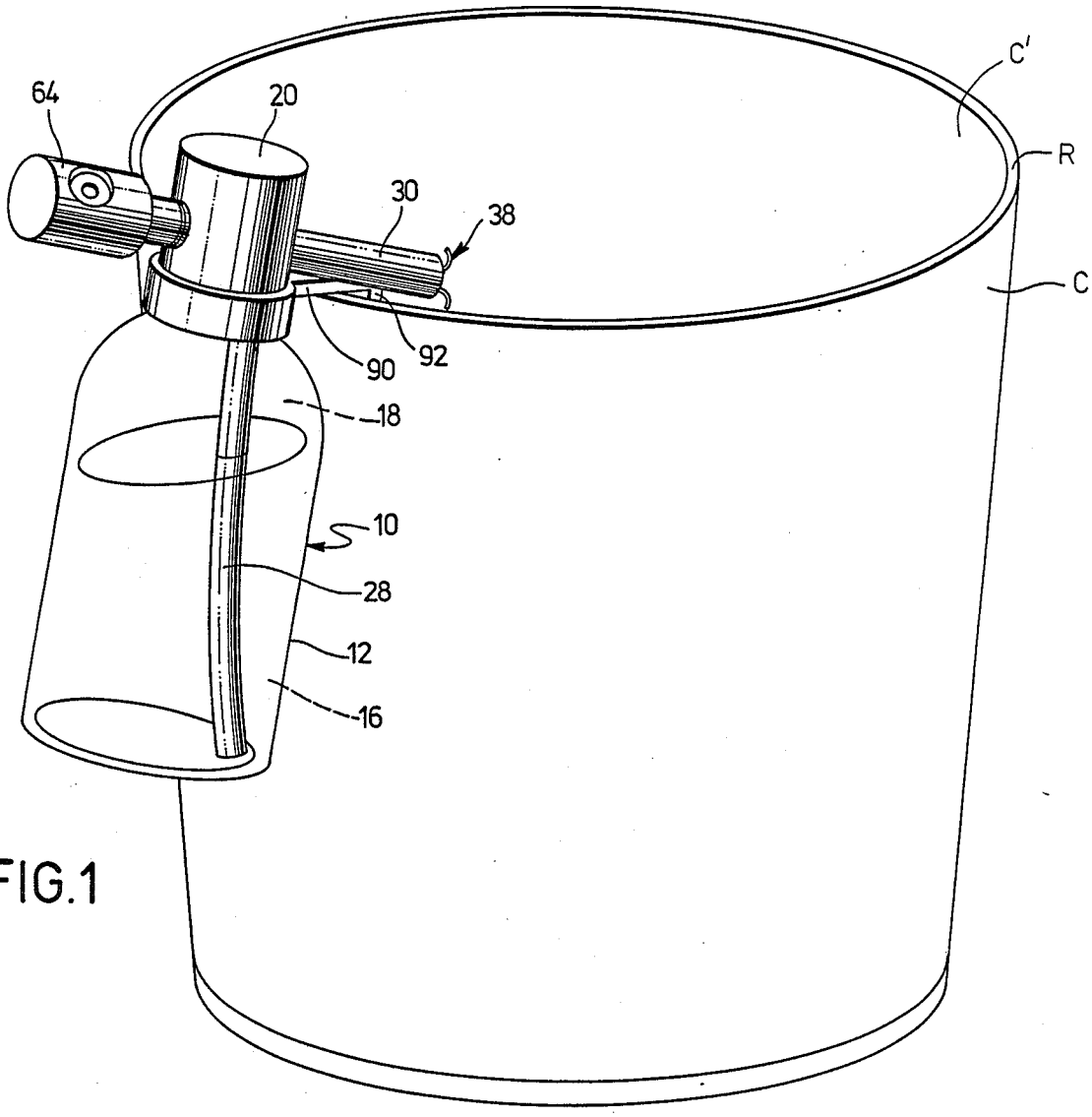
FIG. 1 is a fragmentary perspective view showing a fire extinguisher and alarm apparatus of the present invention as removably mounted on the rim of a container.

Referring now to FIG. 1, there is shown a fire extinguisher and alarm apparatus generally designated 10 which is removably mounted on the rim R of a container C having a cavity C′ to retain combustible materials, such as oil-soaked rags or papers.

Figure 2:
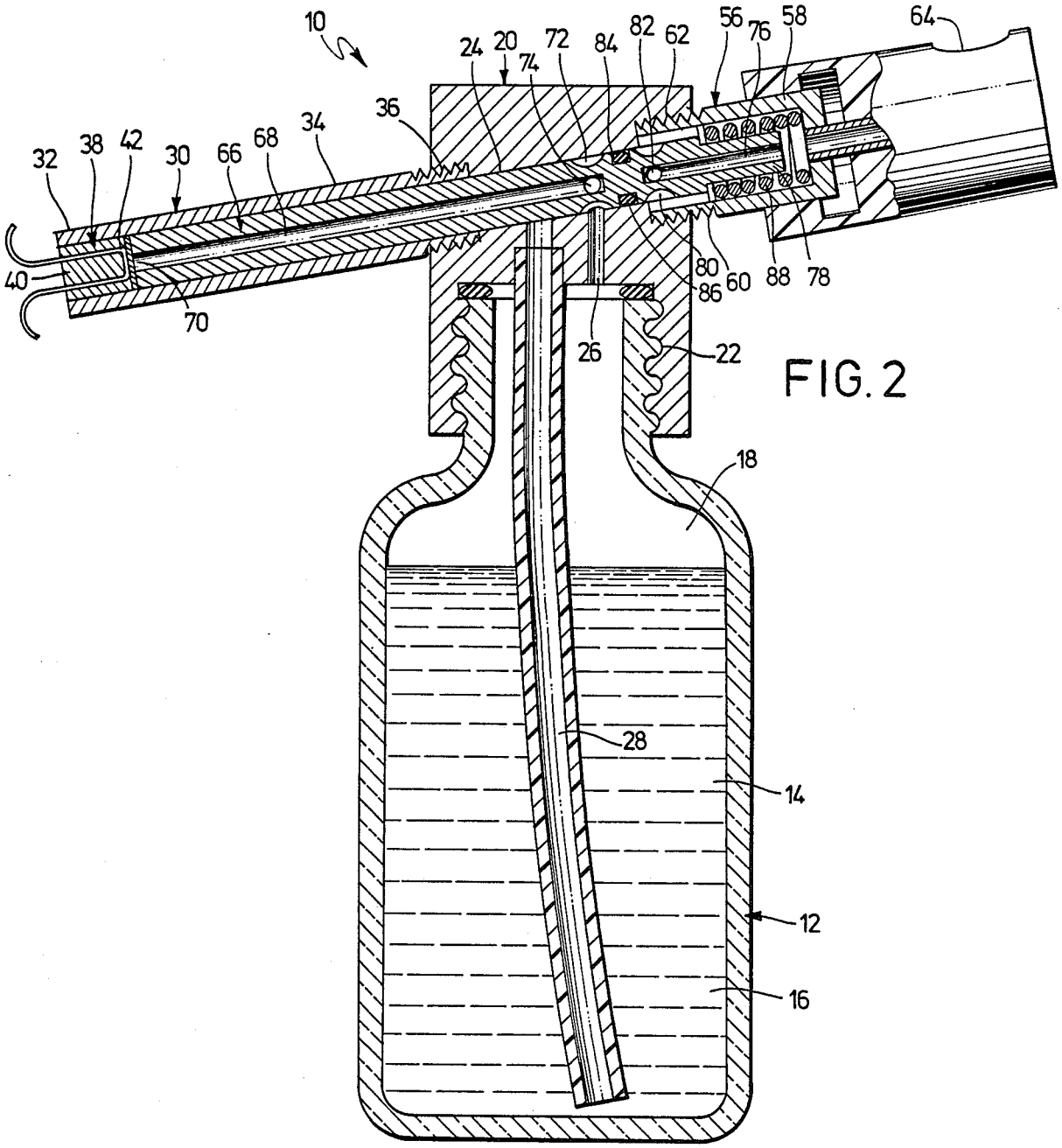
FIG. 2 is a sectional view of the apparatus of FIG. 1 prior to being placed in an actuation mode.
Figure 3:
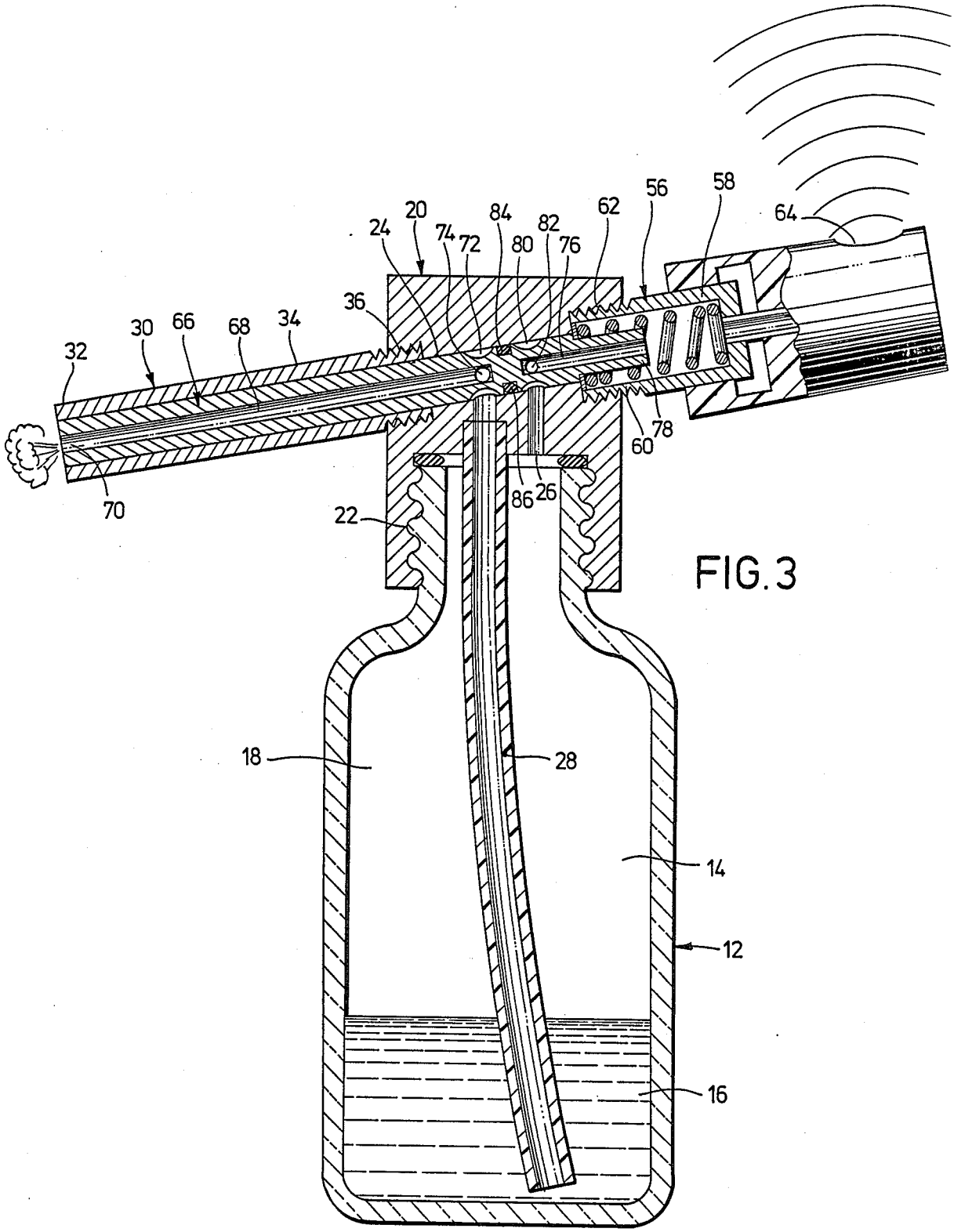
FIG. 3 is a fragmentary sectional view of the apparatus of FIG. 2 showing the apparatus in an actuation mode.

With reference to FIGS. 2 and 3, the apparatus 10 has a reservoir 12 having a chamber 14 for retaining a fire extinguishing liquid 16, such as Halon, and a gas 18, such as Halon, under pressure in the chamber 14. The apparatus 10 has a closure member 20 releasably attached to an upper end of the reservoir 12 by suitable means, such as cooperating threads 22, and having a channel 24 extending therethrough. The closure member 20 has a bore 26 communicating between the channel 24 and the chamber 14 of the reservoir 12.

The apparatus 10 has an elongated tubular section 28 depending from the closure member 20 and communicating between a lower portion of the reservoir chamber 14 and the channel 24 of the closure member 20, such that the liquid 16 is introduced into the tubular section 28.

The apparatus 10 has an elongated hollow nozzle 30 which may be constructed from a suitable metallic material, such as brass. The nozzle 30 has an outer end portion 32 and an inner end portion 34 connected to the closure member 20 by suitable means, such as cooperating threads 36. The nozzle 30 defines an extension of the channel 24 of the closure member 20.

Figure 4:
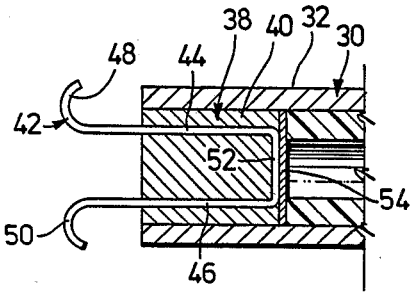
FIG. 4 is a fragmentary sectional view of a heat sensitive plug for a nozzle taken on an enlarged scale.

The apparatus 10 has a temperature sensitive plug 38 which softens in the presence of heat engaged against an inner surface of the outer end portion 32 of the nozzle 30 and closing the channel 24 in the nozzle 30. As best shown in FIG. 4, the plug 38 has a main body portion 40 constructed from a material which softens in the presence of heat, such as 21% indium, 49% bismuth, 18% lead, 12% tin alloy or other suitable alloy or wax as known in the art. The plug 38 also has a heat conductive member 42 in the form of a wire extending through the body portion 40 and out of the plug 38, with the heat conductive member 42 being constructed from copper. The heat conductive member 42 has a pair of spaced sections 44 and 46 extending longitudinally through the body portion 40 and having curved end portions 48 and 50, respectively, located outside the plug 38, with the conductive member 42 having a cross section 52 connecting the longitudinal sections 44 and 46. The plug 38 has an inner disc 54 of heat conductive material, such as copper, with the cross section 52 of the heat conductive member 42 contacting the disc 54. During use of the apparatus 10, heat is conducted by the member 42 into the main body portion 40 and along the disc 54 in order to soften the main body portion 40 and release the engagement of the plug 38 against the nozzle 30, as will be further described below.

With reference to FIGS. 2 and 3, the apparatus 10 has a hollow tubular section 56 having an outer end portion 58 and an inner end portion 60 connected to the closure member 20 by suitable means, such as cooperating threads 62, on a side of the closure member 20 opposite the nozzle 30. As shown, the tubular section 56 defines an extension of the channel 24 of the closure member 20.

The apparatus 10 has an alarm 64 of conventional type connected to the outer end portion 58 of the tubular section 56 and communicating with the channel 24 in the tubular section 56. As known to the art, such an alarm 64 issues an audible signal responsive to gas under pressure. The alarm may be of the type disclosed in U.S. Pat. No. 3,670,690, incorporated herein by reference.

The apparatus 10 has an elongated valve element 66 slidably received in the channel 24. The valve element 66 has an elongated first lumen 68 extending from an intermediate portion of the valve element 66 to an outer end 70 of the valve element 66. The valve element 66 has a first outer annular groove 72 in an outer surface of the valve element 66 adjacent an inner end of the first lumen 68, and a first aperture 74 extending between the first groove 72 and the inner end of the first lumen 68. The valve element 66 has a second lumen 76 spaced from the first lumen 68 and extending from the intermediate portion of the valve element 66 to an inner end 78 of the valve element 66. The valve element has a second annular groove 80 in the outer surface of the valve element 66 adjacent an inner end of the second lumen 76, and a second aperture 82 communicating between the second groove 80 and the inner end of the second lumen 76. The valve element 66 has a third annular groove 84 in an outer surface of the valve element 66 intermediate the first and second grooves 72 and 80, and an 0-ring 86 positioned in the third groove 84 to prevent fluid communication between the first groove 72 and the second groove 80. This 0-ring 86 serves, in the repose position of FIG. 2, to prevent leakage of liquid or gas to the alarm 64.

The valve element 66 is movable between a first position, as shown in FIG. 2, with the outer end 70 engaged against an inner surface of the plug 38, with the first groove 72 disconnected from the reservoir tubular section 28, and with the second groove 80 disconnected from the bore 26, and a second position, as shown in FIG. 3, with the outer end 70 of the valve element 66 located adjacent the outer end of the nozzle 30 with the first groove 72 connected to the reservoir tubular section 28, and with the second groove 80 connected to the bore 26.

The apparatus 10 has a helical spring 88 engaged between the outer end portion 58 of the tubular section 56 and the inner end portion of the valve element 66 in order to bias the valve element 66 from the first position, as shown in FIG. 2, to the second position, as shown in FIG. 3, and drive the plug 38 from the nozzle 30 when the plug 38 softens in the presence of heat, as will be further described below.

With reference to FIG. 1, the closure member 20 has an outwardly directed clip 90 with a downwardly extending flange 92 in order to removably mount the apparatus on the rim R of the container C with the nozzle 30 located adjacent and generally tangentially to the cavity C'. In this configuration, the reservoir 12 is located outside the container C, and the plug 38 is located adjacent the cavity C' in order to sense heat from materials which may burn in the cavity C'.

With reference to FIGS. 1 and 2, with the plug 38 in place in the nozzle 30, the valve element 66 closes the tubular section 28 and bore 26 in order to prevent passage of the liquid 16 and gas 18 outside the reservoir 12. However, if material should begin to burn in the cavity C' of the container C, the plug 38 senses the heat, and the main body portion 40 melts sufficiently to loosen the grip of the plug 38 on the inside of the nozzle 30, and the spring 88 moves the valve element 66 from the first to the second position in order to drive the plug 38 out of the nozzle 30. In this actuated position of the apparatus 10, as shown in FIG. 3, communication is established between tubular section 28 and the first groove 72 of the valve element 66', and the pressure of the gas 18 in the reservoir 12 drives the fire extinguishing liquid 16 through the tubular section 28, the first groove 72, the first aperture 74, and the first lumen 68, out of the valve element 66 and nozzle 30 in a tangential direction along the cavity C' in order to extinguish fire of the materials in the cavity C' without sufficient velocity to blow the materials out of the cavity C' and into the surrounding room. At the same time, communication is established between the bore 26 and the second groove 80 of the valve element 66, such that the gas 18 passes through the bore 26, the second aperture 82, the second lumen 76, and the channel 24 into the alarm 64 in order to simultaneously actuate the alarm 64 in the presence of the gas 18 under pressure from the reservoir 12.

Thus, in accordance with the present invention, an apparatus 10 of the present invention is described which is constructed in a simplified manner for removable placement upon the rim of the container. Upon sensing heat in the cavity of the container, the apparatus is actuated in order to eject fire extinguishing liquid from the apparatus in order to extinguish the fire without sufficient velocity to blow burning materials from the cavity of the container, and simultaneously to actuate an audible alarm to warn of the fire.

Figure 5:
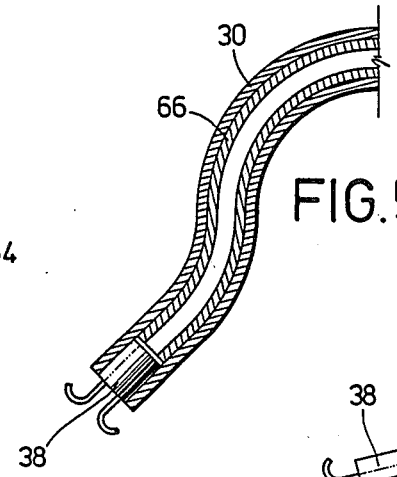
FIG. 5 is a fragmentary sectional view of a nozzle and plug in an alternative embodiment.
Figure 6:
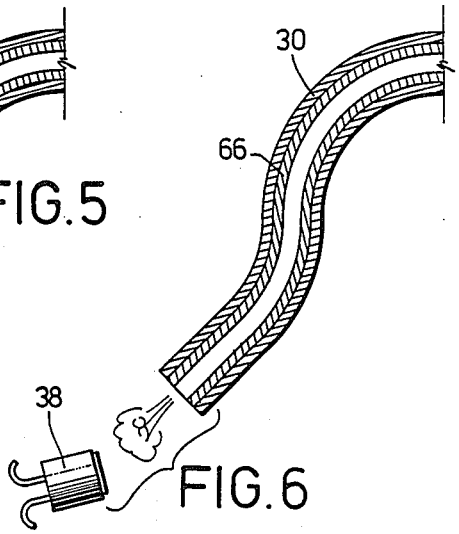
FIG. 6 is a fragmentary sectional view of the nozzle and plug of FIG. 5 with the plug being ejected from the nozzle.

Another embodiment of the present invention is illustrated in FIGS. 5 and 6, in which like reference numerals designate like parts. In this embodiment, the nozzle 30 and valve element 66 are constructed from a flexible or malleable material, such that they may be located at a desired position adjacent the container cavity C'. The plug 38 is shown in position in the outer end portion of the nozzle 30 in FIG. 5, and the apparatus is shown as actuated in FIG. 6 with the plug 38 having been driven out of the nozzle 30 by the valve element 66.

Figure 7:
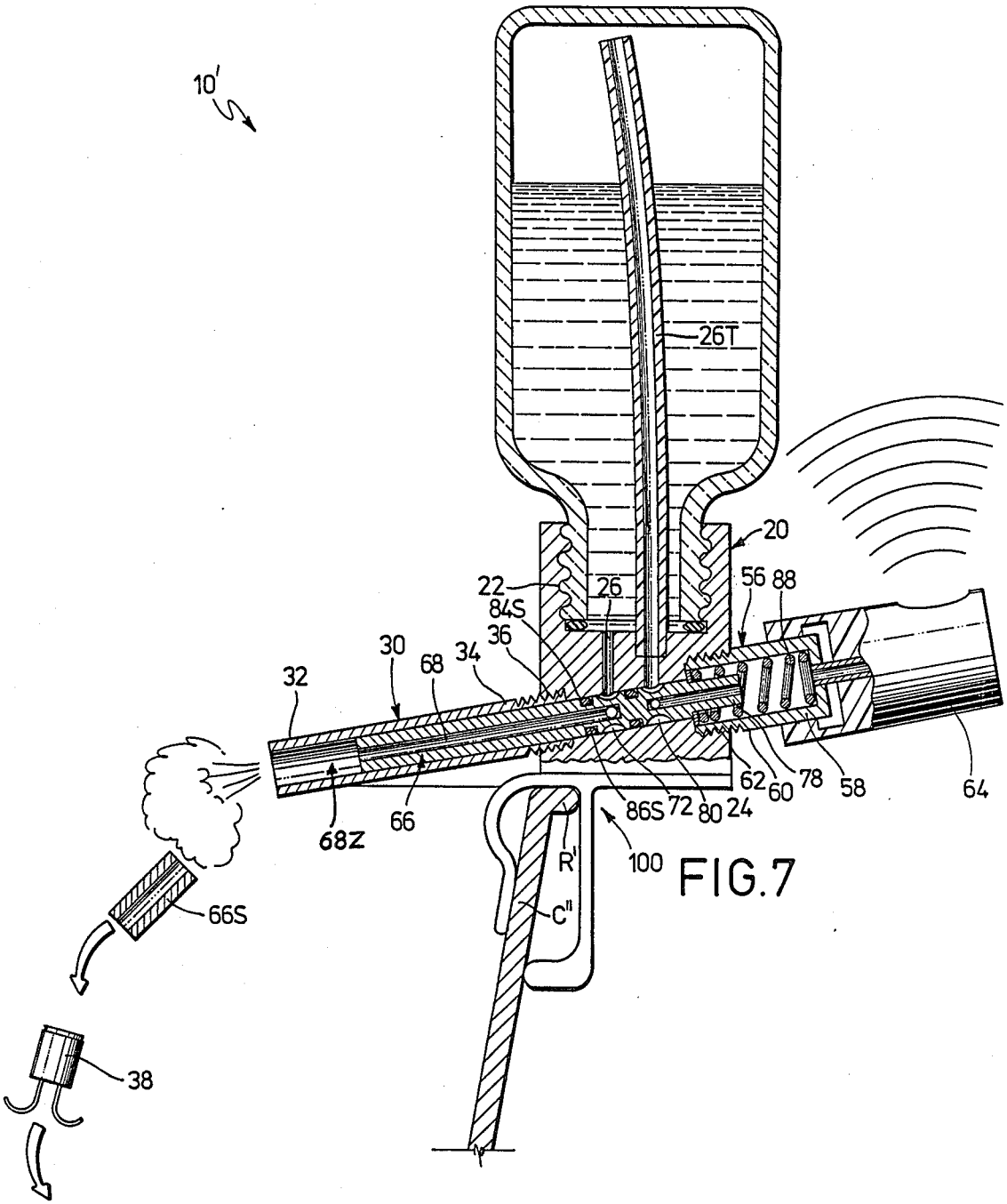
FIG. 7 is a sectional view of an alternative embodiment of the invention in an actuation mode.

Referring to FIG. 7, there is depicted a further embodiment of the invention which is generally designated by the number 10'. This embodiment 10' is similar to that of the previous unit 10 except that it is mounted with the chamber 12 atop of the valve unit. In this embodiment, the liquid receiving opening 28' does not have a siphon tube. Instead, the gas receiving base 26' is provided with a tube 26T which extends to the top or gaseous phase of the container.

A second O-Ring and groove 86S and 84S are provided forward of the liquid receiving base 72 so as to prevent liquid from entering the tube when in the standby mode. (The top of the tube 26T may be fitted with a "snorkel" like valve to keep liquid from entering it but allowing gas to pass through it unimpeded.)

Also provided for the unit 10' is a rim clamp arrangement 100 for snapping over the rim R' of a wastepaper basket or like container C".

The unit 10' also includes a spacer section 66S which is also ejected, as shown, so as to provide an enlarged diameter zone 68Z at the discharge point for the now gaseous anti-fire material. This enlarged discharge zone 68Z serves to allow the gas to expand under controlled conditions and thus to exit the tube 38 at a lower velocity than otherwise would be the case.

The spacer and zone arrangement may be employed with the embodiments of FIGS. 1–6.

Several prototypes of the invention have been made, tested, and shown to work well. These prototypes essentially followed the construction of the FIGS. 1–4 embodiment. For purposes of definiteness of disclosure but not for purposes of limitation, the details of one such prototype will be hereafter set out. It should be clearly understood that the invention may be practiced in many forms and that the inventor, himself, may well decide to change the details and manner of his practicing the invention, as future experience indicates or to adapt it to different environments.

One successfully tested prototype employed a plug 38 having an outside diameter of 5/16 inch and a length of ¼ inch. The disc 70 was of copper 0.010 inch thick and had a diameter of 9/32 inch. Its main (meltable) body was Cerro Metals Alloy "low 136", an alloy of 49% bismuth, 21% indium, 18% lead, and 12% tin. The copper wire forming the horns was a section of #12 gauge conventional electrical copper conductor. This plug was designed to release, reading approximately 136 degrees, F. (Of course, for different environments, other temperature alloys could be used, and alloys are well known in this art.) The plug was cast in place at the end of the tube by first inserting the disc 54 and the member 42 and then pouring in molten alloy and allowing it to harden in place. This effectively solders the plug in place to the tube 32, until the heat from a fire releases it.

The valve unit was formed of a brass tubing set into a plastic top and employed a machined sliding valve made of brass. In commercial production, the member 66 would preferably be made of Torlon grade 9040. The gas discharge tube had an inside diameter of approximately ⅜ inch. The Halon container was of glass and was charged with Halon 1211 obtained from Great Lakes Chemical Co. This is believed to be Bromochlorodifluromethane (C Br $CLF_2$). The audio alarm unit was made from a modified commercially purchased "Screamer", manufactured by Qualco Products Co. of Fernwood, N.J. Of course, many different gas pressure operated alarm units can be used.

The foregoing detailed description is given for clarity of understanding only, and no unnecessary limitations should be understood therefrom, as modifications will be obvious to those skilled in the art. For example, other materials known to the art may be utilized as liquid and gas in the reservoir.

What is claimed is:

1. A fire extinguisher and alarm apparatus for a container having a rim and a cavity to retain combustible materials, comprising:

a reservoir having a chamber for retaining a fire extinguishing fluid under gas pressure said reservoir also containing gas under pressure;

a hollow nozzle for ejecting the fire extinguishing fluid;

temperature sensitive means which softens in the presence of heat;

means for mounting the reservoir on the container rim with the nozzle and temperature sensitive means located adjacent the container cavity;

an alarm which issues a signal responsive to gas under pressure; and valve means responsive to softening of the temperature sensitive means for simultaneously connecting the fire extinguishing fluid in the reservoir to the nozzle for ejection therethrough into the container cavity and connecting said gas under pressure in said reservoir to the alarm to issue the signal.

2. The apparatus of claim 1 wherein the temperature sensitive means is associated wit the nozzle.

3. The apparatus of claim 2 wherein the temperature sensitive means comprises a plug located in an outer end of the nozzle.

4. The apparatus of claim 1 wherein the nozzle is directed generally tangentially to the container cavity.

5. The apparatus of claim 1 wherein the reservoir is removably mounted on the container rim.

6. A fire extinguisher and alarm apparatus for a container having a rim and a cavity to retain combustible materials, comprising:

a reservoir having a chamber for retaining a fire extinguishing liquid and a gas under pressure;

an elongated hollow nozzle having an outer end portion;

means defining an elongated channel including a portion in said nozzle;

a temperature sensitive plug which softens in the presence of heat frictionally engaged against the inside of the outer end portion of the nozzle and closing the channel;

an alarm which issues an audible signal responsive to gas under pressure;

first means for establishing communication with the fire extinguishing liquid in the reservoir;

second means for establishing communication with the gas in the reservoir;

a valve element slidably received in the channel and having a first lumen in an outer end portion thereof and a second spaced lumen in an inner portion thereof and communicating with the alarm, said valve element being movable between a first inner position with the outer end portion engaged against an inner surface of the plug, with the first establishing means disconnected from the first lumen, and with the second establishing means disconnected from the second lumen, and a second outer position with the outer end portion of the valve element located adjacent the outer end portion of the nozzle, with the first establishing means connected to the first lumen to eject the fire extinguishing liquid through the first establishing means and first lumen, and with the second establishing means connected to the second lumen to permit passage of the gas through the second establishing means and second lumen in order to actuate the alarm;

means for biasing the valve element from the first to second position such that the biasing means drives the plug by the valve element out of the nozzle when it softens and moves the valve element from the first to second position; and means for removably mounting the apparatus on the rim of the container with the nozzle located generally tangentially to the cavity.

7. The apparatus of claim 6 wherein the plug comprises a main body portion constructed from a material which softens in the presence of heat, and a heat conductive member extending through the body portion and out of the plug.

8. The apparatus of claim 7 wherein the heat conductive member comprises a wire having spaced sections extending longitudinally through the body portion and having curved end portions located outside the plug, said wire having a cross section connecting the longitudinal sections.

9. The apparatus of claim 8 wherein the plug has an inner disc of heat conductive material and in which the cross section of the wire contacts the disc.

10. The apparatus of claim 6 wherein the outer end portions of the nozzle and valve element are constructed from a flexible material.

11. The apparatus of claim 6 wherein the mounting means comprises a clip.

12. A fire extinguisher and alarm apparatus for a container having a rim and a cavity to retain combustible materials, comprising:

a reservoir having a chamber for retaining a fire extinguishing liquid and a gas under pressure;

a closure member releasably attached to an upper end of the reservoir and having a channel extending therethrough and a bore communicating between the channel and the chamber of the reservoir;

a tubular section depending from the closure member and communicating between a lower portion of the reservoir and the channel of the closure member;

an elongated hollow nozzle having an outer end portion and an inner end portion connected to the closure member, said nozzle defining an extension of the channel of the closure member;

a temperature sensitive plug which softens in the presence of heat frictionally engaged against the inside of the outer end portion of the nozzle and closing the channel in the nozzle;

a hollow tubular section having an outer end portion and an inner end portion connected to the closure member on a side opposite the nozzle, said tubular section defining an extension of the channel of the closure member;

an alarm connected to the outer end portion of the tubular section and communicating with the channel, said alarm issuing an audible signal responsive to gas under pressure;

an elongated valve element slidably received in the channel and having a first lumen extending from an intermediate portion of the valve element to an outer end thereof, a first annular groove in an outer surface of the valve element adjacent an inner end of the first lumen, and a first aperture extending between the first groove and the inner end of the first lumen, said valve element having a second lumen spaced from the first lumen and extending from the intermediate portion of the valve element to an inner end thereof, a second annular groove in the outer surface of the valve element adjacent an inner end of the second lumen, and a second aperture communicating between the second groove and the inner end of the second lumen, said valve element being movable between a first position with the outer end thereof engaged against an inner surface of the plug with the first groove disconnected from the reservoir tubular section, and with the second groove disconnected from the bore, and a second position with the outer end of the valve element located adjacent the outer end of the nozzle with the first groove connected to the reservoir tubular section, and with the second groove connected to the bore;

a helical spring engaged between the outer end portion of the tubular section and the valve element to bias the valve element from the first to second position and drive the plug from the nozzle when it softens in the pressure of heat; and means for removably mounting the apparatus on the rim of the container with the nozzle located directly tangentially to the cavity.

13. The apparatus of claim 12 including a third annular groove in an outer surface of the valve element intermediate the first and second grooves and an O-ring positioned in the third groove.

14. A temperature sensitive plug apparatus for use in a fire extinguisher having a discharge tube for fitting within the end of that tube and for unplugging that tube, in the presence of heat, comprising:

a generally cylindrical body sized to tightly fit within and engage a portion of the inside of the discharge tube, said body being primarily composed of a material that softens in the presence of heat; and wherein heat conductive means extends through said body and projects out of the plug apparatus and said heat conductive means comprises spaced apart elongated sections of heat conductor means extending longitudinally through said body and having spaced apart end portions located outside the plug, said conductor means having a cross section connecting the longitudinal sections.

15. The plug apparatus of claim 14 wherein said conductor means includes a disc of heat conductive material provided in contact with the inner surface of said cylindrical body an in heat conductive contact with said longitudinal sections.

16. The plug apparatus of claim 14 in which a disc of material which does not appreciably soften in the presence of heat is provided across the inner end of the cylindrical body.

17. The plug apparatus of claim 16 wherein said disc is made of copper and has a diameter slightly under the diameter of said body and the inside diameter of said tube.

* * * * *

UNITED STATES PATENT AND TRADEMARK OFFICE

CERTIFICATE OF CORRECTION

PATENT NO. : 4,805,701

DATED : February 21, 1989

INVENTOR(S) : George S. Mountford

It is certified that error appears in the above-identified patent and that said Letters Patent is hereby corrected as shown below:

Title page:

In the Abstract, Line 9: Delete "ajacent" and substitute --adjacent--

Column 6, Line 30: Delete "wit" and substitute --with--

Column 8, Line 55: Delete "an" and substitute --and--

Signed and Sealed this

Fifth Day of September, 1989

*Attest:*

DONALD J. QUIGG

*Attesting Officer*

*Commissioner of Patents and Trademarks*